US005203085A

United States Patent [19]

Berns

[11] Patent Number: 5,203,085

[45] Date of Patent: Apr. 20, 1993

[54] KNIFE

[75] Inventor: Marald Berns, Wuppertal, Fed. Rep. of Germany

[73] Assignee: Martor-Argentax E.H. Beermann KG, Solingen, Fed. Rep. of Germany

[21] Appl. No.: 876,235

[22] Filed: Apr. 30, 1992

[30] Foreign Application Priority Data

Jan. 2, 1992 [DE] Fed. Rep. of Germany ..... 4200018

[51] Int. Cl.[5] ..... B26B 3/06

[52] U.S. Cl. ..... 30/163; 30/162; 30/355

[58] Field of Search ..... 30/162, 160, 161, 163, 30/335

[56] References Cited

U.S. PATENT DOCUMENTS 1,623,906 4/1927 Brooks ..... 30/162
3,999,290 12/1976 Wood ..... 30/162
4,769,912 9/1988 Davis ..... 30/162

FOREIGN PATENT DOCUMENTS 244517 6/1991 European Pat. Off. .
649406 1/1951 United Kingdom ..... 30/162

*Primary Examiner*—Frank T. Yost
*Assistant Examiner*—Hwei-Siu Payer
*Attorney, Agent, or Firm*—Herbert Dubno; Yuri Kateshov

[57] ABSTRACT

A safety utility knife has a weighted pawl which, upon a slip of the knife, disengages from a blade holder to allow the latter to be retracted by a spring. The tooth of the blade holder engages the blocking surface of the pawl with only line or point contact and the blocking surface itself is tangential to a circle centered on the pawl pivot axis. The pawl spring is a coil spring extending in the direction of displacement of the blade holder and generally corresponds to the retraction spring.

14 Claims, 4 Drawing Sheets

KNIFE

FIELD OF THE INVENTION

My present invention relates to a knife, for example, a utility knife, having a hollow handle in which a blade holder is longitudinally shiftable. More particularly, the invention relates to a knife of this type in which the blade holder is retractable by the spring upon disengagement of a pawl therefrom, upon the slipping of the knife or for a like safety reason.

BACKGROUND OF THE INVENTION

In EP-0 244 517 B1, a knife is described in which, within a hollow handle, a blade holder is longitudinally shiftable and is retracted by an elongated tension coil spring anchored to the holder, the pawl of this device, which engages a tooth on the holder and can serve as an inertial mass which is dislodged from the tooth upon a centrifugal action of the blade.

That device provides the pawl with spring loading against the holder so that, when the blade holder is shifted within the hollow handle toward the opening of the latter so that the blade will protrude through this opening, the holder will be locked or retained in the operative or extended position of the blade. A gravitational or centrifugal action can be used to project the blade from the holder.

In practice it has been found that the pawl required a rather excessive range of motion of the knife to effect its release. Stated otherwise, the sensitivity of the pawl to slipping of the knife or some manipulation which requires the safety action of withdrawal of the blade was limited.

In general, therefore, an excessive displacement of the knife to effect retraction of the blade means that the knife is not as safe as is desirable.

OBJECTS OF THE INVENTION

It is, therefore, the principal object of the present invention to provide an improved knife with greater sensitivity of untoward movements of the handle or grip and which will effect retraction of the blade with less of a displacement of the knife than has hitherto been the case while nevertheless reliably retaining the blade in its operative position during normal use.

Another object of the invention is to improve upon the prior art knife specifically described above with respect to its sensitivity and safety.

A more general object of the invention is to provide a highly reliable safety knife of the type in which the blade can be propelled from the housing or handle and latched in its operative or extended position for use by a centrifugal displacement of the knife and will reliably retract the blade upon a displacement of the handle signalling the need for a safety response.

SUMMARY OF THE INVENTION

These objects are attained, in accordance with the invention, with a knife which comprises:

an elongated hollow handle having an opening at one end;

a blade holder longitudinally shiftable in the handle, adapted to receive a blade, and displaceable between an operative position wherein the blade extends from the opening and a retracted position wherein the blade is withdrawn through the opening into an interior of the handle;

a first longitudinally extending coil tension spring generally parallel to a direction of displacement of the holder within the handle and connected to the holder for retracting the holder from the operative position to the retracted position;

an extension on the holder projecting rearwardly in the handle generally along the first spring and formed with a locking tooth;

a locking pawl swingably mounted in the handle for pivotal movement about a pivot axis therein and formed with a detent recess receiving the tooth and having a substantially planar blocking surface substantially tangential to a pivot circle of the surface centered on the axis for engagement by the tooth in the operative position of the holder, thereby retaining the holder in the operative position, the pawl being swingable about the axis away from the tooth to release the tooth from the surface and permit the first spring to retract the holder to the retracted position, the tooth being shaped so as to engage the surface only at an apex of the tooth; and a second longitudinally extending coil tension spring in the handle connected to the pawl and biasing the pawl toward the extension.

Thus, in addition to the retracting spring which is elongated and extends generally parallel to the direction of displacement of the blade holder within the hollow handle or housing, the pawl spring is also a longitudinally extending or elongated tension spring and the tooth of the holder is so shaped that it engages the planar blocking surface of the pawl when the holder is held in its operative position corresponding to the extended position of the blade, only at its apex. The blocking surface of the pawl, in turn, lies substantially tangential to a circle centered on the pivot axis of the pawl. This pawl may also extend generally parallel to the path of displacement of the plate holder and its extension formed with the tooth.

With the knife of EP 0 244 517, the pawl spring is constituted by a short compression spring. By comparison with this system, the safety knife of the invention provides the pawl spring as an elongated, relatively soft tension spring which has the advantage over a short compression spring that there is only a minimum variation of the restoring force per unit change in the length of the spring. In other words, over the entire displacement of the pawl spring, the restoring force remains substantially constant in the system of the invention Stated otherwise, the longitudinally-extending soft tension spring of the invention has a relatively flat spring characteristic (restoring force versus spring displacement) by comparison with the spring characteristic of the pawl spring of the earlier safety knife which is very steep. I have found that even with fabrication tolerances which are common in the manufacture of such safety knives, with the elongated soft tension spring of the invention the reproducibility of knife to knife of the action of the pawl and the blade holder is high and deviations resulting from fabrication tolerances are minimized.

By contrast with the earlier system, there were significant variations in the response of the knife attributable to manufacturing tolerances. As a consequence, in the mass production of such safety knives in accordance with the invention, the response is found not to change over large production runs, the sensor, namely the pawl, has a practically constant response and, as a practical matter, the knives are safer because of the improved reproducibility.

With the knife of EP 0 244 517 B1, moreover, the tooth engages a blocking surface of the holder projection of the blade holder in such manner that the pawl spring must initially be stressed to a given degree before the sensor, namely, the pawl, is released from engagement with the holder.

According to the invention, a unique tooth geometry is provided which makes the knife more sensitive to the occurrence of a manipulation requiring blade retraction. To increase the sensitivity of the prior art knife, the pawl of the latter is given additional weight so that inertial action will be increased. That, however, has the drawback of making the knife as a whole heavier and of decreasing the ease of manipulation of the knife.

The increased sensitivity has been found to be a function, moreover, of the fact that only the apex of the tooth engages the planar blocking surface of the pawl with point or line contact and further in such manner that the planar surface is substantially tangential to the circle center of the pivot axis of the pawl at the point of contact of the tooth with the planar surface in the blocking position, i.e. the position in which the blade holder is retained in its operative position and the blade extends from the opening of the handle or housing.

This feature of the invention, whereby only the point of the tooth engages the planar surface whose axis is tangential to the aforementioned circle and thus perpendicular to a radius from the fulcrum or center of the pivot of the pawl and the point or line contact of the tooth with its surface is the only contact, provides a unique function at the locking point.

On the one hand, it securely retains the blade holder against retraction while the pawl is in its rest position but, on the other hand allows the pawl to swing freely without impediment by the tooth when the holder is to be released. The retention, therefore, is a labile arresting of the pawl in its blocking position which contrasts with the system of EP 0 244 517 B1, requiring a significant compression of the pawl spring, before the blade holder is released.

Consequently, the elongated relatively soft tension spring can provide a constant reproducibly restoring force upon the pawl which prevents the sensitivity from changing with time and from knife to knife in mass production and, in combination with the engagement of the tooth with the tangential planar blocking surface, ensures that a relatively reduced inertial mass of the pawl can provide the desired release effect.

The tangential orientation of the blocking surface affords an initially unstable arresting position of the pawl in the sense that the frictional force applied by the tooth is comparatively small as is the effect of the biting of the tooth against this surface.

Since a reduced inertial mass can be employed by comparison with that of EP 0 244 517 B1, the movement of the pawl is made independent of gravity and thus of the particular position of the handle in space.

With the prior art safety knife according to EP 0 244 517 B1, the blade holder can be set into its operative or blade-extended position by an operating part which can project form the handle or grip.

This requirement for a separate manipulation to move the blade into its extended position may prove to be a drawback since the actuating member itself may create an interference when rapid retraction is in order. For example, that member or element may catch on something which prevents the blade from being fully retracted.

With the system of the invention, a special actuating part for the blade holder is eliminated and it is possible to simply exert a centrifugal action on the knife to fling the blade into its operative and extended position, i.e. cutting position, whereupon the pawl will automatically engage the tooth and retain the operative position of the blade. This facilitates the use of the knife and allows it to be used in many cases in which separate actuation of the blade may not be convenient. According to a feature of the invention, the pawl spring extends along side the longitudinally-extending single arm lever which forms the pawl. In this case the length of the pawl spring should be such that the latter engages the pawl proximal to the pivot of the pawl on the handle.

For reproducibility of the knife in mass production and the most varied and widespread application of the knife, friction in the retraction system from knife to knife should be low and more or less the same so that greater resistance to retraction of the blade holder will not occur in some knives.

The fabrication-independent system for minimizing such friction and the effect thereof on the safety system can be obtained when the pawl is formed as a single-arm lever and is pivotally mounted with play on a pivot pin fixed at a gripper body side of the handle, i.e. toward an end of the handle remote from the opening through which the blade is to project.

To limit any canting of the pawl, thus fulcrumed at one end, the invention provides that the pawl at its opposite or free end will cooperate with guide projections disposed at both sides of the pivot plane of the pawl on the two halves from which the hollow handle is assembled.

According to another feature of the invention, a weight is provided on the pawl at its free end away from the pivot. This ensures that the weighted lever arm will be minimized and hence the moment provided by the weight will be high. Here too the weighting of the elongated pawl provides a significant improvement over the pawl of EP 0 244 517 B1.

It has been found to be advantageous for the handling aspects of the knife to enable the weights to be replaceable on the pawl. Indeed, a set of mutually interchangeable weights, all of the same external dimensions but composed of different material and having different densities, may be provided. The sensor, namely the pawl, which is to respond to a dangerous situation, may thus have its sensitivity or responsiveness varied by replacement of the weight.

If the knife is to be used under conditions which might create large accelerations, smaller inertial masses can be employed for the pawl than in applications in which small accelerations are to trigger retraction of the blade.

When, for example, for very uniform cutting and a low retraction threshold for the safety mechanism, a modification of the pawl is provided, a relatively large mass with an insert body of high density, e.g. from steel, may be selected. To permit a choice of the insert to be introduced into the recess or seat in the pawl, the hollow interior of the handle can be provided with at least one compartment for at least one reserve insert, in addition to the insert accommodated in the seat of the pawl.

It has been found to be advantageous, in this regard to provide the pawl at its free end with a cylindrical socket into which interchangeable cylindrical inserts (weights)

can be selectively inserted, the weights having the configurations of right circular cylinders.

To prevent the inserts from canting and thus creating problems with a swinging movement of the pawl, I can provide guides along the opposite ends of the inserts on the housing which prevent canting and enable the pawl to swing effectively. The socket can have an axial length up to half the axial length of the insert body. In this manner, the insert body can be loose or can float in the pawl but nevertheless is coupled with it only for movement in the pivot plane.

Finally, the pawl spring and the restoring spring anchored to the blade holder can be mutually identical parts which are interchangeable. This has been found to be advantageous not only for mass productions of the knife but because it allows reassembly of the knife without concern as to which spring is used for which apparatus. Interchanging the springs, therefore, will not alter the sensitivity of response of the safety mechanism for release of the blade holder for retraction.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
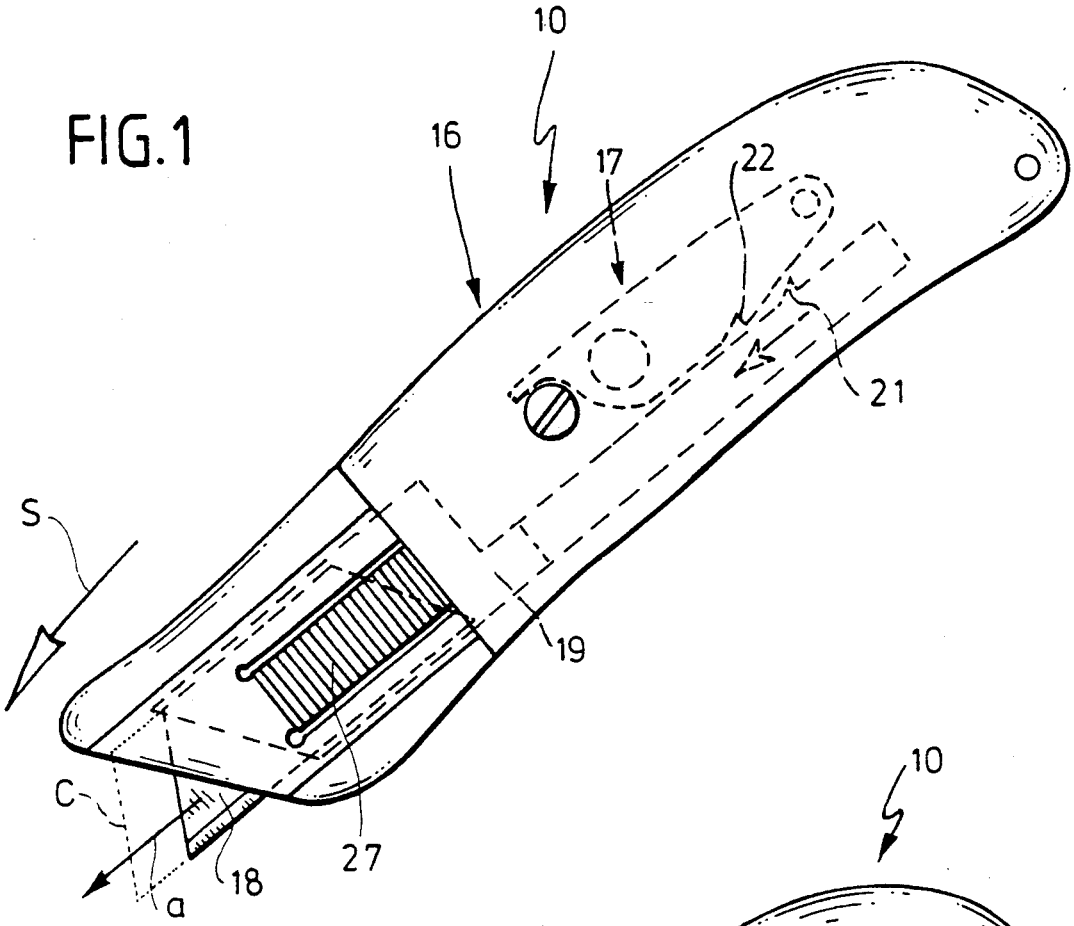
FIG. 1 is a side elevational view partly in diagrammatic form, illustrating the principles of the invention and showing the centrifugal action for extending the blade.

In the drawing I have shown a utility knife 10 which comprises a handle formed from two gripper shells 11 and 12 formfittingly engageable with one another and releasably connected, e.g. by a screw 15.

Figure 5:
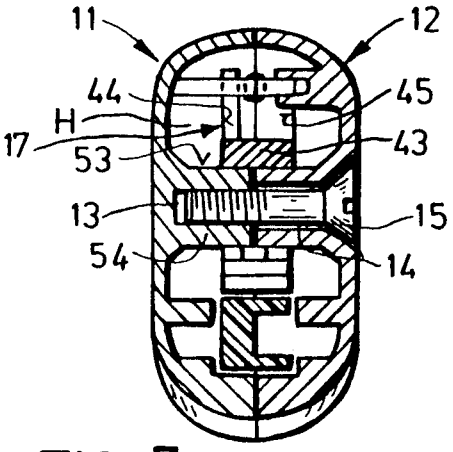

For this purpose, the shell 11 (FIG. 5) is provided with a blind threaded bore 13 while the gripper shell 12 has an opening 14 aligned therewith and through which the screw 15 is threaded into the bore 13.

The gripper shells 11 and 12 thus form the handle or gripper body 16 which has a hollow interior H accommodating the remaining functional parts of the knife 10 to be described.

Figure 2:
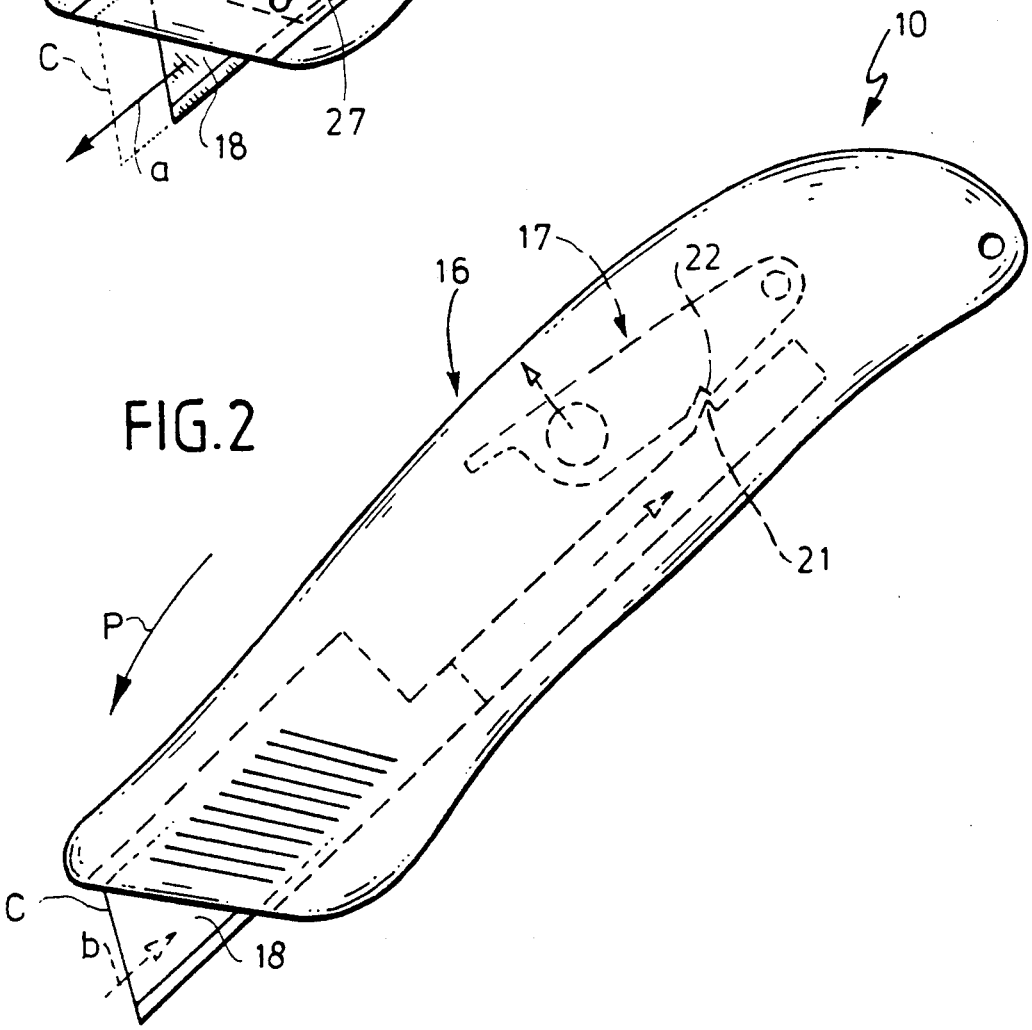
FIG. 2 is a view similar to FIG. 1 showing the knife with the blade in the cutting position in which the pawl has just been displaced out of engagement with the tooth as a result of a sudden movement of the knife.

As is already apparent from the somewhat schematic illustrations of FIGS. 1 and 2, these major functional parts include a locking pawl 17 which is the sensor or monitor for the movement of the knife which will trigger retraction of the blade.

The blade holder itself is represented at 19 and carries a replaceable blade 18 which is of the standard utility-knife type, the holder 19 being linearly shiftable in the handle and having a rearwardly-extending projection 20 which is also referred to herein as a rear extension. The latter is formed with a locking tooth 21 which is engageable with the blocking surface 22 of the pawl 17.

Figure 3:
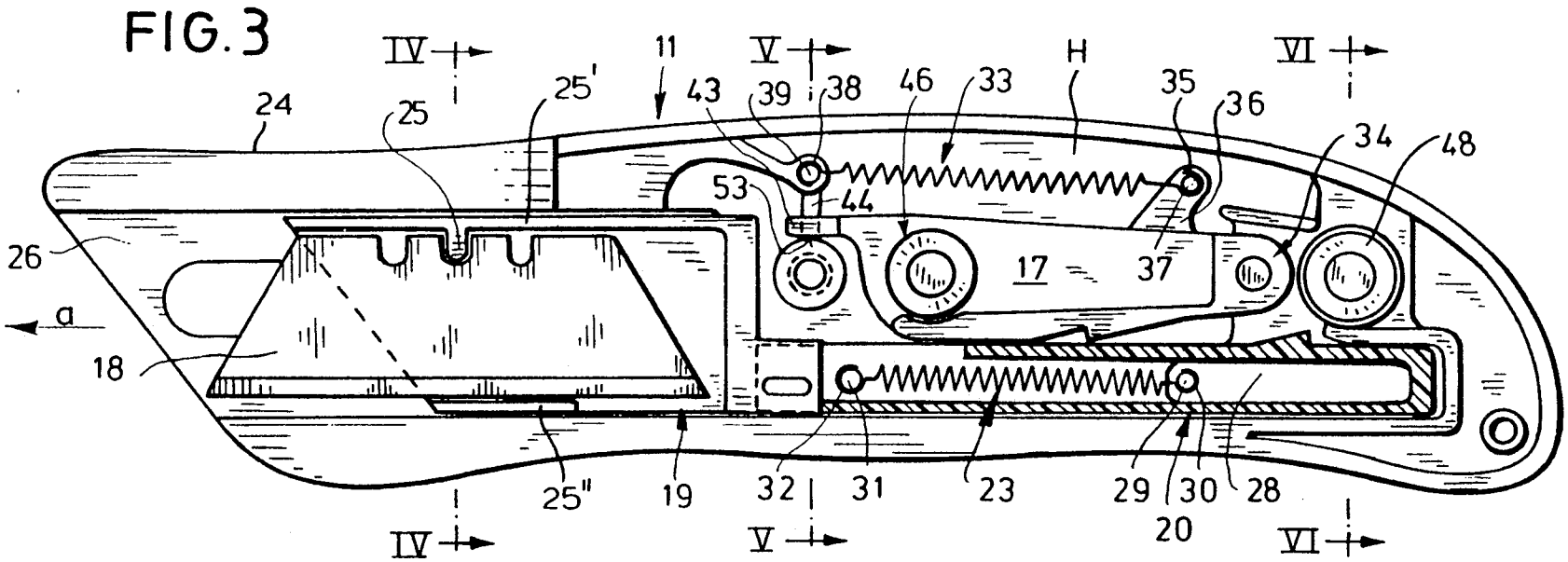
FIG. 3 is a longitudinal cross sectional plane being taken parallel to a broad surface of the handle and showing the blade in its fully retracted position.
Figure 6:
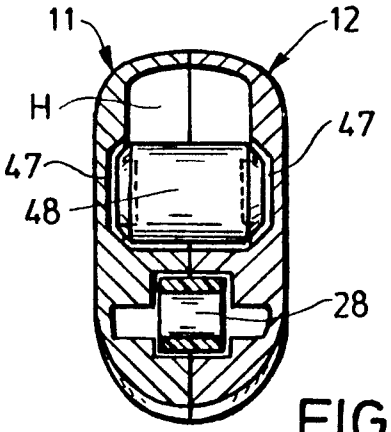
FIGS. 4–6 are cross sectional views taken respectively along lines IV—IV, V—V and VI—VI of FIG. 3.

The extension direction, i.e. the direction in which the blade 18 and hence its holder 19 must move to extend the blade into the working position has been represented by the arrow a in FIG. 3 and the retraction position is represented by the arrow b, the retracted position, of course, being the position in which the blade 18 is protected against contact with the user.

From FIG. 1, moreover, it can be seen that when the working hand of the user flings the handle through an angular position represented by the curved arrow S, the weighted mass formed by the blade holder 19 receives a centrifugal displacement in the direction of arrow a relative to the handle body 16 so that the blade holder is displaced until the blocking surface 22 of the pawl 17 can engage behind the tooth 21.

Figure 7:
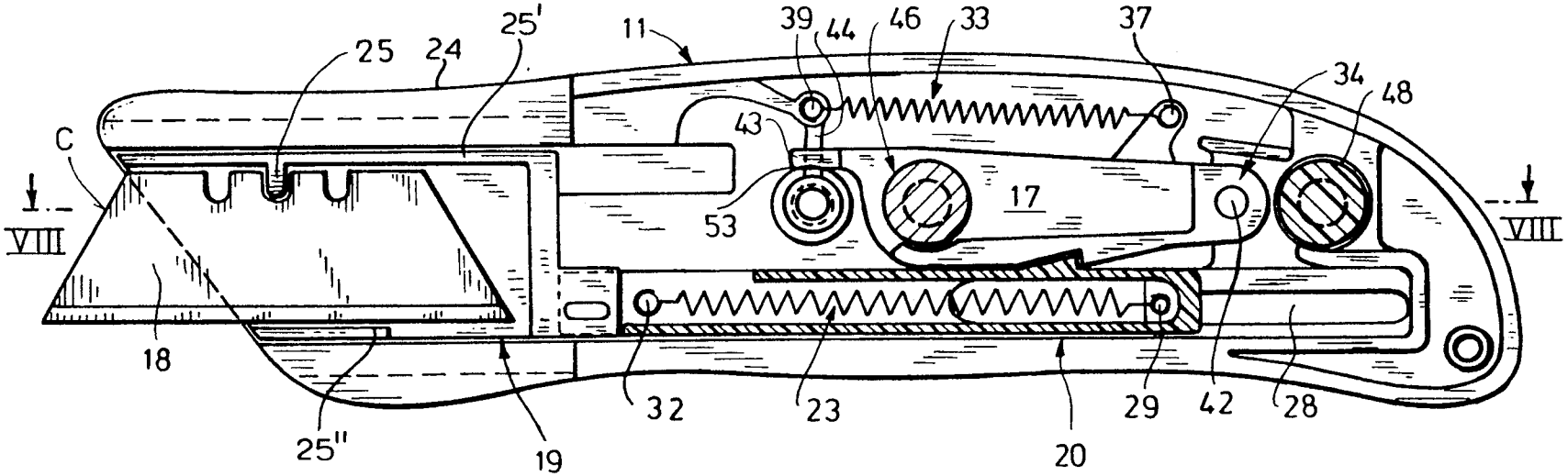
FIG. 7 is a cross sectional view similar to FIG. 3 showing the blade holder in its operative position, i.e. the blade extended.

In this manner, the blade 18 is blocked in the apparatus or cutting position C represented in dotted lines in FIG. 1 and in solid lines in FIGS. 2 and 7.

The pawl 17 also forms an inertial mass, i.e. is weighted as will be described hereinafter so that, upon the occurrence of a sudden movement of the knife 10 as represented by the arrow P in FIG. 2, symbolizing a slip of the knife or the like, the handle 16 will move relative to the inertial pawl 17 and extract the tooth 21 from engagement with the blocking surface 22 and allow the tension retracting spring 23 to rapidly draw the blade holder and the blade in the direction of arrow b into the protected position shown in FIG. 3.

Structural details of the knife 10 will be apparent especially from FIGS. 3–9.

Figure 4:
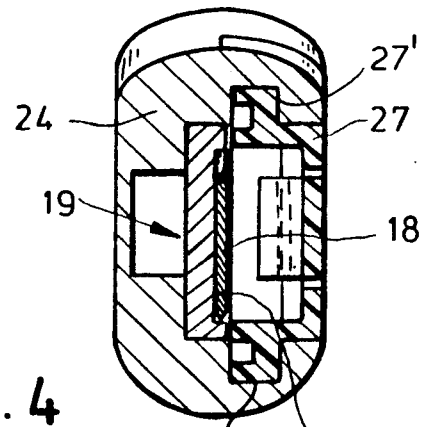

The blade holder 19 is linearly slidable in a guide channel 26 formed in a guide projection 24 of the shell 11 (FIGS. 3, 4 and 7). The blade holder 19 is provided with a pair of ribs 25' and 25'', flanking the trapezoidal blade 18 and the rib 25' is formed with an entraining projection 25 engageable in a notch at the back of the blade 18 as is conventional in utility knives.

It is also conventional to cover the channel 26 with a closure or cover 27 (FIGS. 4 and 8) which can slide in guide channels 27' and 27'' of the handle (FIG. 4) and has a latch **27*a* engageable with the shell 12. The cover 27 may be grooved at 27*b* to facilitate its movement by the thumb of the user. The cover 27**, therefore can be removed for blade replacement, the blade can be laterally inserted or removed, and the cover again locked in place.

The extension 20 is rigidly connected with the holder 19 and has a longitudinally-extending frame-like configuration, having a rear end formed with an opening 28 over its entire thickness. The opening 28 is engaged by the holding pin 29 fixed in the grip half 11 and engaged by the rearmost eye 30 of the coil tension spring 23.

The front eye 31 of the latter is engaged on a pin 32 affixed to the extension 20. As a consequence, the spring 23, mounted under pretension will draw the holder 19 in the direction of arrow b. Concomitently upon a movement of the holder 19 with its pin 32 in the direction of arrow a, the spring 23 will be tensioned.

Like the retracting spring 23, a pawl spring 33 is also elongated and a comparatively soft tension coil spring. Springs 3 and 23 are identical parts and have the same characteristics so that they may be interchanged on assembly. The pawl spring 33 extends along one side of the elongated lever forming the pawl 17. The pawl spring 33 has its rear eye 35 engaged with a pin 37 on an arm 36 unitary with the pawl 17 and formed on an end thereof close to a journal or pivot 34 at which the pawl 17 is swingably mounted.

The front eye 38 of the pawl spring 33 engages a pin 39 fixed on the shell 11.

The pivot assembly 34 of the pawl 17 comprises an end of the pawl 17 which surrounds with play the pivot pin 42 which is fitted into blind bores 40 and 41 of the grip shells 11 and 12.

To prevent tilting of the pawl 17 and a possible blocking of the movement of the pawl, at the free end of the pawl 17, a T-shaped formation 43 is provided which is latterly engaged by guide tracks 44 and 45 of the shells 11 and 12 and loosely guided thereby while being supported by these guide tracks.

At the free end of the pawl 17, i.e. at its end opposite the pivotable assembly 34, the pawl can be weighted by replaceable cylindrical weights fitted into a seat formed by a circularly cylindrical boss 46, for example, of steel, which provides weighting of the pawl itself. A reserve weight 48 which can be selected from one stored in a cavity or compartment 47 at the rear of the handle (FIGS. 7 and 8), can be inserted into the opening or seat 49 formed in the pawl interchangeably with the insert 46 and can be composed of a material of looser density, for example, of plastic.

Figure 8:
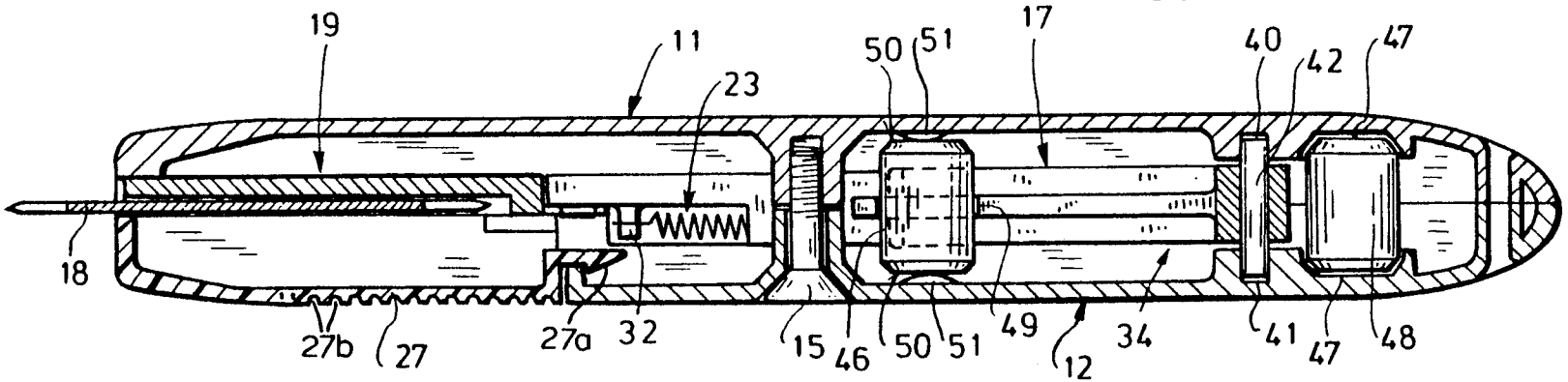
FIG. 8 is a cross sectional view taken along the line VIII—VIII of FIG. 7 and thus in a plane at a right angle to the section plane of FIG. 7.

As is especially apparent from FIG. 8, the seat for the insert 46 can be formed with a circularly cylindrical opening 49 in which the insert 46 is engaged for only half or less of its axial length so that it can be easily inserted and removed axially. Both end faces 50 of the insert 46 are loosely engaged by guide ribs 51 of the housing and thus are prevented from canting.

The inserts 46 and 48 are composed of different materials but have identical dimensions.

Figure 9:
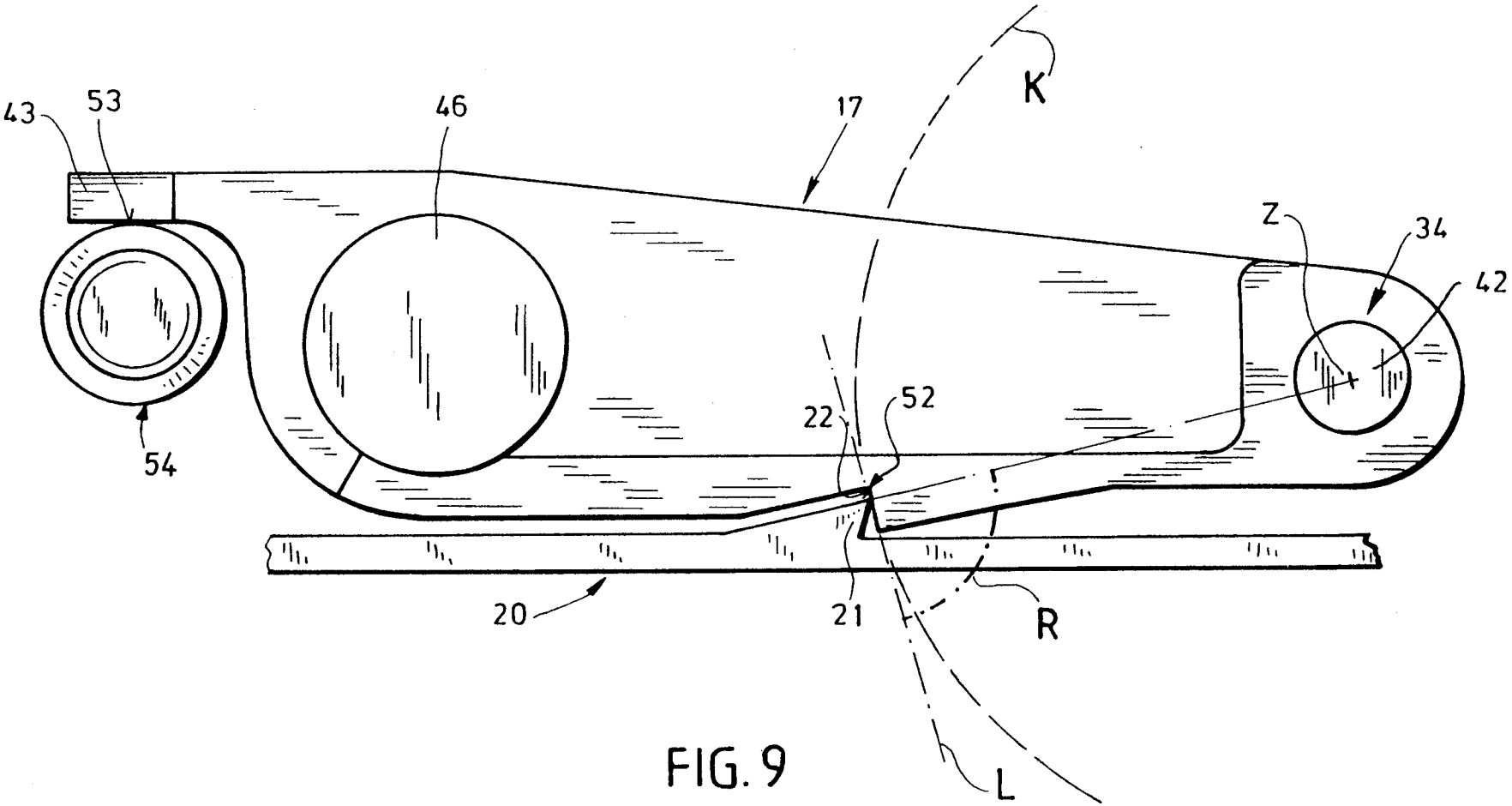
FIG. 9 is a somewhat diagrammatic detail view of the pawl and its blocking surface engageable with the tooth of the blade holder projection.

From FIG. 9 it is apparent that the longitudinal axis L of the planar blocking surface 22 is tangential to the circle K described by the surface 22 about the pivot axis Z of the pivot assembly 34 of the pawl 17. The apex 52 of the tooth 21 is in line contact with the blocking surface 22 so that an angle R between the axis L and an imaginary line connecting the pivot axis Z with the apex is approximately 90°.

From FIG. 9 it will also be apparent that the T-shaped formation 43 is at rest against an abutment 53 in the horizontal housing under the tension effect of the pawl spring 33. The abutment 53 is formed by the sleeve 54 which surrounds the blind bore 13. The abutment provides a defined position for engagement of the tooth 21 against the locking surface 22 and a certain lateral spacing of the extension 20 from the pawl 17 to eliminate friction which otherwise might arise between these two relatively movable parts.

From FIG. 9 it is also apparent that (see FIG. 2) the elements 21 and 17 are readily disengaged by a sharp accidental movement of the blade 10 to immediately retract the blade into the housing. However, the relative movements of the parts of the system are such that, compared to earlier systems, there is a sharper release threshold so that normal cutting operations can be effected without repeatedly having to propel the blade 18 into its operative position and without undesired retraction of the blade and release of the pawl 17. Since the replacement weights 46 and 48 can be easily interchanged, different release thresholds and sensitivities can be obtained. When the insert 46 is composed of steel to increase the inertial mass of the pawl 17, a low threshold and high retraction sensitivity is obtained. The threshold is increased when, instead of the weight 46, the much lighter weight 48 is used.

I claim:

1. A knife, comprising:

an elongated hollow handle having an opening at one end;

a blade holder longitudinally shiftable in said handle, adapted to receive a blade, and displaceable between an operative position wherein said blade extends from said opening and a retracted position wherein said blade is withdrawn through said opening into an interior of said handle;

a first longitudinally extending coil tension spring generally parallel to a direction of displacement of said holder within said handle and connected to said holder for retracting said holder from said operative position to said retracted position;

an extension on said holder projecting rearwardly in said handle generally along said first spring and formed with a locking tooth;

a locking pawl swingably mounted in said handle for pivotal movement about a pivot axis therein and formed with a detent recess receiving said tooth and having a substantially planar blocking surface substantially tangential to a pivot circle of said surface centered on said axis for engagement by said tooth in said operative position of said holder, thereby retaining said holder in said operative position, said pawl being swingable about said axis away from said tooth to release said tooth from said surface and permit said first spring to retract said holder to said retracted position, said tooth being shaped so as to engage said surface only at an apex of said tooth; and a second longitudinally extending coil tension spring in said handle connected to said pawl and biasing said pawl toward said extension.

2. The knife defined in claim 1 wherein said pawl is formed with an inertial mass automatically swinging said pawl away from said tooth against said second spring to release said tooth from said surface upon centrifugal movement of the knife in a cut-slipping motion in a hand of a user.

3. The knife defined in claim 1 wherein said pawl has a configuration of an elongated single-arm lever pivotally connected to said hollow handle only at one end, said second spring extending alongside said pawl.

4. The knife defined in claim 3, further comprising means for connecting said second spring to said pawl at a location close to said pivot axis.

5. The knife defined in claim 1 wherein said pawl is an elongated single-arm lever fulcrumed with play in said hollow handle at a location remote from said opening at a handgrip side of said handle and has a free end guided between guide tracks formed on said housing.

6. The knife defined in claim 1 wherein said pawl is provided with a weight at an end thereof opposite an end pivotally connected to said hollow handle at said axis.

7. The knife defined in claim 6 wherein said pawl is provided with a seat and said weight is replaceable received in said seat.

8. The knife defined in claim 7, further comprising means for storing at least one replacement weight, said replacement weight being interchangeable with said weight on said pawl and receivable in said seat upon removing said weight, said replacement weight and said weight on said pawl being composed of materials of different densities.

9. The knife defined in claim 8 wherein said weights have identical outer dimensions.

10. The knife defined in claim 9 wherein said handle is formed with a compartment for said replacement weight interchangeable with said weight on said pawl.

11. The knife defined in claim 10 wherein said seat is a cylindrical opening.

12. The knife defined in claim 11 wherein said replacement weight is configured as a right-circular cylinder.

13. The knife defined in claim 12 wherein said weight is received in said cylindrical opening so as to be easily inserted into and removed therefrom, said cylindrical opening having an axial length of at most half an axial length of the weight, said hollow handle having guide ribs engageable with ends of said weight on said pawl.

14. The knife defined in claim 1 wherein said springs are identical parts.

* * * * *

UNITED STATES PATENT AND TRADEMARK OFFICE

CERTIFICATE OF CORRECTION

PATENT NO. : 5,203,085

DATED : 20 April 1993

INVENTOR(S) : Harald BERNS

It is certified that error appears in the above-identified patent and that said Letters Patent is hereby corrected as shown below:

Title Page: Inventor information should read:

-- [75] Inventor: Harald Berns, Wuppertal, Fed. Rep. of Germany --.

Signed and Sealed this

First Day of February, 1994

Bruce Lehman

*Attest:*

BRUCE LEHMAN

*Attesting Officer*

*Commissioner of Patents and Trademarks*